US010292503B2

(12) United States Patent
Brown

(10) Patent No.: US 10,292,503 B2
(45) Date of Patent: May 21, 2019

(54) PORTABLE ADJUSTABLE CHAIR

(71) Applicant: Shaun Walter Brown, Ottawa (CA)

(72) Inventor: Shaun Walter Brown, Ottawa (CA)

(73) Assignee: Shaun Walter Brown, Ottawa (CA)

( * ) Notice: Subject to any disclaimer, the term of this patent is extended or adjusted under 35 U.S.C. 154(b) by 0 days.

(21) Appl. No.: 15/816,586

(22) Filed: Nov. 17, 2017

(65) Prior Publication Data

US 2018/0140102 A1 May 24, 2018

Related U.S. Application Data

(60) Provisional application No. 62/423,921, filed on Nov. 18, 2016.

(51) Int. Cl.

| | |
|---|---|
| ***A47C 4/00*** | (2006.01) |
| ***A47C 4/10*** | (2006.01) |
| ***A47C 4/12*** | (2006.01) |
| ***A47C 4/20*** | (2006.01) |
| ***A47C 4/22*** | (2006.01) |
| ***A47C 4/28*** | (2006.01) |
| ***A47C 4/42*** | (2006.01) |
| ***A47C 4/44*** | (2006.01) |
| ***A47C 4/46*** | (2006.01) |
| ***A47C 1/14*** | (2006.01) |
| ***A47C 13/00*** | (2006.01) |
| ***A47C 7/00*** | (2006.01) |
| ***A47C 5/10*** | (2006.01) |

(52) U.S. Cl.

CPC ..... *A47C 13/00* (2013.01); *A47C 1/14* (2013.01); *A47C 4/20* (2013.01); *A47C 5/10* (2013.01); *A47C 7/002* (2013.01); *A47C 7/008* (2013.01)

(58) Field of Classification Search

CPC ..... A47C 1/14; A47C 7/002; A47C 7/008; A47C 4/20; A47C 5/10; A47C 13/00

USPC ..... 297/16.1, 19, 21, 22, 45, 51, 53, 58

See application file for complete search history.

(56) References Cited

U.S. PATENT DOCUMENTS

| | | | | |
|---|---|---|---|---|
| 2,871,921 A * | 2/1959 | Arnold | A47C 4/283 297/45 X |
| 2,905,513 A * | 9/1959 | Kane | A47B 3/00 108/128 |
| 2,978,012 A * | 4/1961 | Norseen | A47C 4/20 108/116 |
| 4,772,068 A * | 9/1988 | Gleckler | A47C 7/002 297/39 X |

(Continued)

*Primary Examiner* — Rodney B White

(74) *Attorney, Agent, or Firm* — Servilla Whitney LLC

(57) ABSTRACT

A portable adjustable chair is disclosed comprising a seating area for receiving a person having a front portion and a back portion. A front support connected to the front portion of the seating area for supporting the front portion of the seating area is also provided and a back support connected to the back portion of the seating area for supporting the back portion of the seating area. The chair also has a fulcrum member allowing movement of the back support and removing support for the back portion of the seating area provided by the back support while allowing the front support to support the front portion of the seating area and a support member connected to the seating area to support the back portion of the seating area when the back support is not supporting the back portion of the seating area.

6 Claims, 10 Drawing Sheets

(56) References Cited

U.S. PATENT DOCUMENTS 5,364,163 A * 11/1994 Hardison ..... A47C 3/18 297/344.21
5,494,333 A * 2/1996 Wilson ..... A47C 7/002 297/35 X
5,499,856 A * 3/1996 Sorrell ..... A61H 3/04 297/16.1 X
6,036,148 A * 3/2000 Shank ..... A47C 7/008 248/188.2
6,386,627 B1 * 5/2002 Tsai ..... A47C 4/24 297/16.1
6,450,569 B1 * 9/2002 Liu ..... A47C 4/20 297/35
6,471,287 B1 * 10/2002 Liu ..... A47C 3/029 297/32
6,820,928 B1 * 11/2004 Ransom ..... A47C 4/10 297/51 X
6,905,172 B1 * 6/2005 Barnett ..... A47C 7/002 248/188.5
8,251,442 B2 * 8/2012 Grace ..... A47C 4/286 297/16.2
8,465,090 B1 * 6/2013 O'Connor ..... A47C 7/62 297/184.16
8,960,784 B1 * 2/2015 De Berry ..... A47C 7/008 297/16.1
9,301,616 B2 * 4/2016 Miller ..... A47C 4/04
9,314,100 B1 * 4/2016 Logan ..... A47C 1/14
9,532,653 B2 * 1/2017 Green ..... A47C 7/008
2008/0290699 A1 * 11/2008 Golias ..... A47D 1/002 297/16.1
2009/0295198 A1 * 12/2009 Tomasi ..... A47D 1/002 297/16.1
2013/0026799 A1 * 1/2013 Miller ..... A47C 4/46 297/19
2014/0097647 A1 * 4/2014 Grace ..... A47C 3/0255 297/42
2015/0313364 A1 * 11/2015 Miller ..... A47C 4/04 297/19
2016/0135600 A1 * 5/2016 Chen ..... A47C 1/0265 297/42 X

* cited by examiner

PORTABLE ADJUSTABLE CHAIR

CROSS-REFERENCE TO RELATED APPLICATIONS

This application claims priority to U.S. Provisional Application No. 62/423,921, filed Nov. 18, 2016, the entire disclosure of which is hereby incorporated by reference herein.

FIELD OF THE INVENTION

The present invention relates to portable chairs and more specifically to portable chairs which can be adjusted for varying seating use.

BACKGROUND OF THE INVENTION

Portable chairs have been used by many people in the summer months to enjoy the outside weather. A variety of portable chairs have been designed, however, none are adjustable for use in the truck beds allowing for the portable chair to be easily adjusted and ease of use in a truck bed.

SUMMARY OF THE INVENTION

In a first aspect, the present invention provides a portable adjustable chair comprising a seating area for receiving a person having a front portion and a back portion. The chair also has a front support connected to the front portion of the seating area for supporting the front portion of the seating area and a back support connected to the back portion of the seating area for supporting the back portion of the seating area. A fulcrum member is also provided within the chair allowing movement of the back support and removing support for the back portion of the seating area provided by the back support while allowing the front support to support the front portion of the seating area and a support member connected to the seating area to support the back portion of the seating area when the back support is not supporting the back portion of the seating area.

BRIEF DESCRIPTION OF THE DRAWINGS

The embodiments of the present invention will now be described by reference to the following figures, in which identical reference numerals in different figures indicate identical elements and in which.

The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention.

DETAILED DESCRIPTION OF THE INVENTION

The terms "coupled" and "connected", along with their derivatives, may be used herein. It should be understood that these terms are not intended as synonyms for each other. Rather, in particular embodiments, "connected" may be used to indicate that two or more elements are in direct physical or electrical contact with each other. "Coupled" may be used to indicated that two or more elements are in either direct or indirect (with other intervening elements between them) physical or electrical contact with each other, or that the two or more elements co-operate or interact with each other (e.g. as in a cause and effect relationship).

The present invention includes an adjustable chair comprising a seating area for receiving a person having a front portion and a back portion; a front support connected to the front portion of the seating area for supporting the front portion of the seating area; a back support connected to the back portion of the seating area for supporting the back portion of the seating area; a fulcrum member allowing movement of the back support and removing support for the back portion of the seating area provided by the back support while allowing the front support to support the front portion of the seating area; and a support member connected to the seating area to support the back portion of the seating area when the back support is not supporting the back portion of the seating area.

Figure 1:
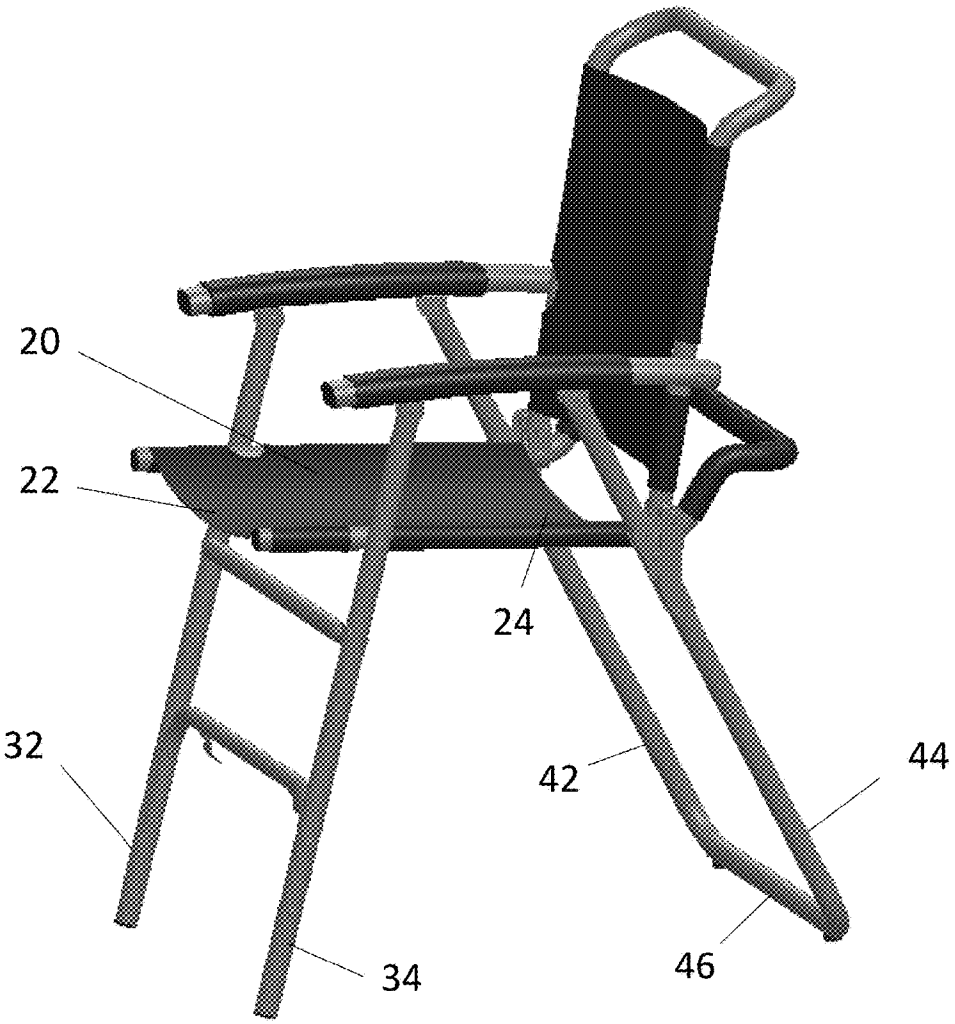
FIG. 1 is a is a perspective view of a portable adaptable chair according to one embodiment of the present invention.

With reference to FIG. 1 and according to one embodiment of the present invention, a portable adjustable chair 10 is shown. The portable adjustable chair 10 has a seating area 20 with a front portion 22 and a back portion 24. Chair 10 has a front support which comprises two legs 32, 34 in order to support the front portion 22 of seating area 20. Chair 10 also has a back support which comprises two legs 42, 44 and cross member 46 in order to support the back portion 24 of seating area 20. A worker skilled in the relevant art would be familiar with support constructions which do not require cross member 46. For example, legs 42 and 44 could be identical to legs 32 and 34 which are not interconnected with a bottom cross member similar to cross member 46.

A worker skilled in the relevant art would also be familiar with front or back supports which could consist of a single leg. The presence of a single leg in either the front or back support would require the opposing support to have at least two legs. For example, if the front support has only one leg then the back support requires two legs and vice versa if the back support has only one leg then front support requires at least two legs.

Figure 2:
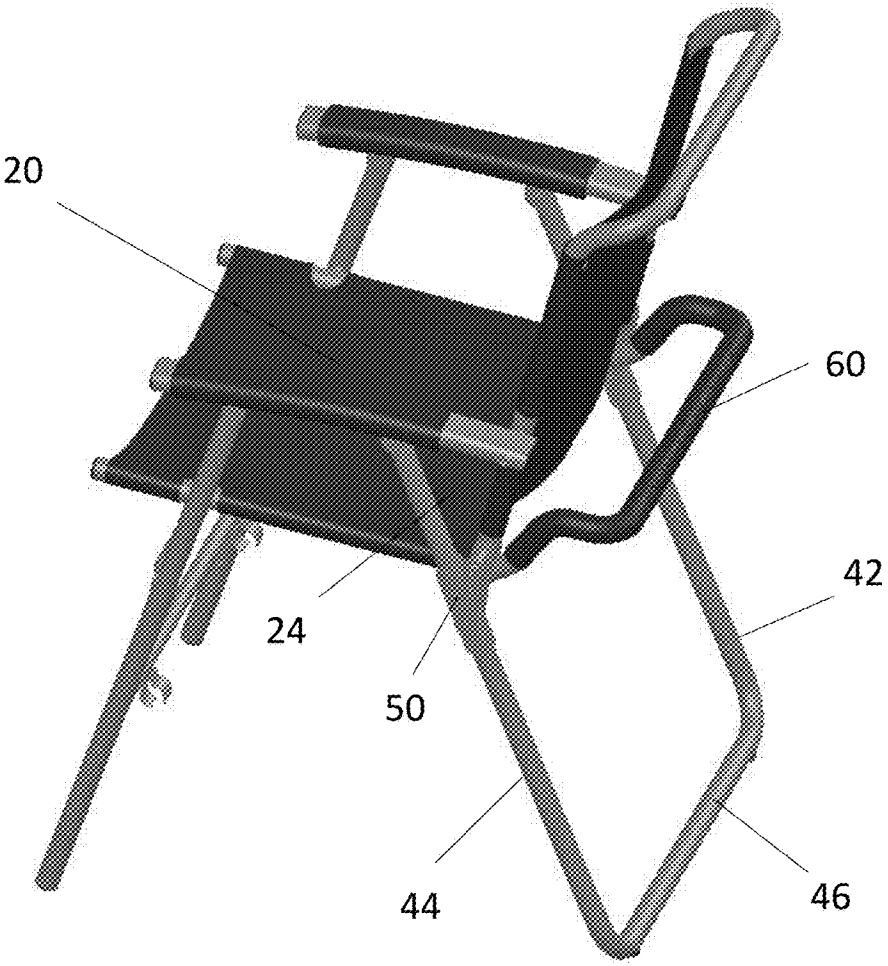
FIG. 2 is a rear perspective view of a portable adaptable chair according to one embodiment of the present invention.

With reference to FIGS. 1 and 2 and according to one embodiment of the present invention, chair 10 has a fulcrum member 50 which allows for the movement of back support which comprises legs 42, 44 and cross member 46. The fulcrum member 50 will be further defined in other figures below. Chair 10 is also shown in FIG. 1 in a standard configuration allowing for chair 10 to be used in a variety of places such as outside or around a camp fire as is typically used by individuals. Chair 10 also has a support member 60 which allows support of the back portion 24 of the seating area 20 when the back support is not supporting the back portion 24 of seating area 20. The function of support member 60 is further explained below when chair 10 is not in a standard configuration as shown in FIG. 1.

With reference to FIG. 2 and according to one embodiment of the present invention, the chair 10 has a support member 60 which is the entire length of the chair 10. Support member 60 has a specific function when the back support consisting of legs 42, 44 and cross member 46 are adjusted and do not support back portion 24 of seating area 20. A worker skilled in the relevant art would be familiar with various lengths, shapes and dimensions which would still allow support member 60 to support the back portion 24 of seating area 20 without being the entire width of chair 10.

Figure 3:
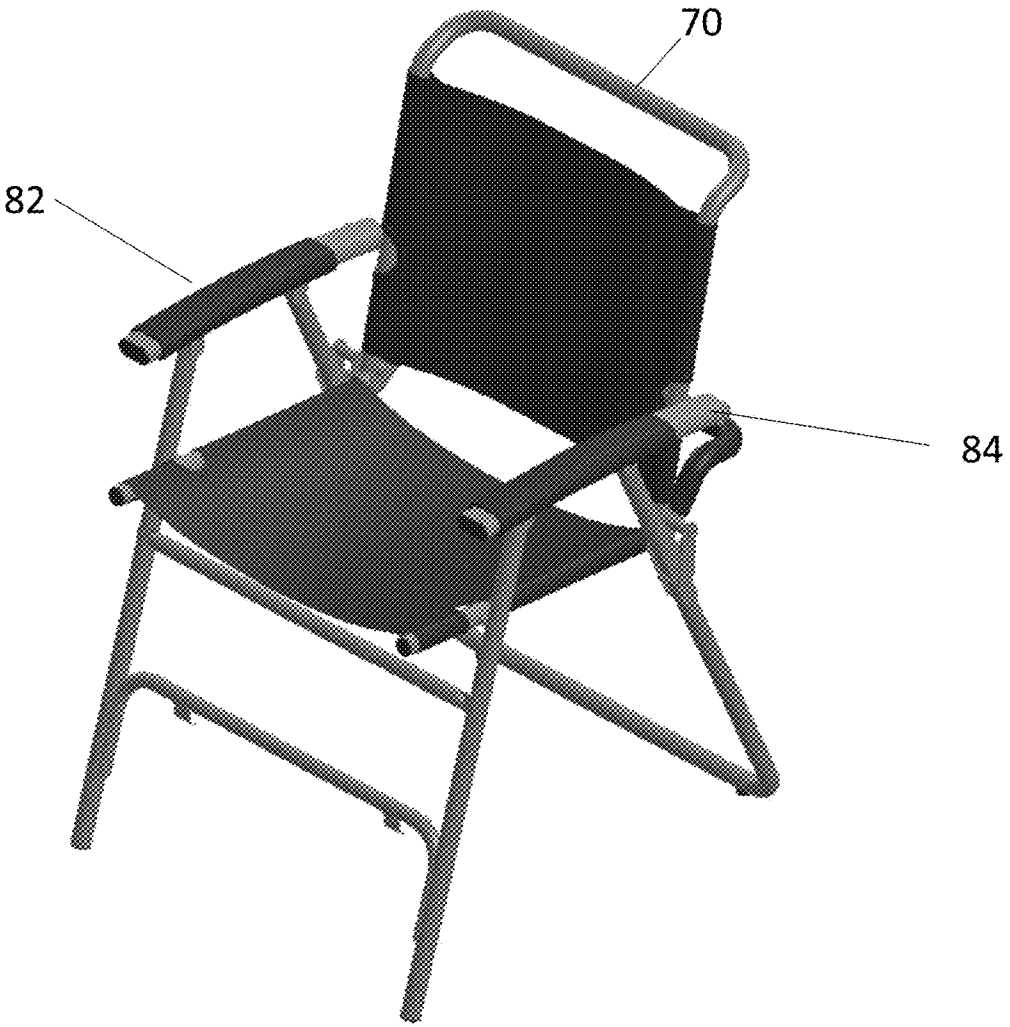
FIG. 3 is another top perspective view of a portable adaptable chair according to one embodiment of the present invention.

With reference to FIG. 3 and according to one embodiment of the present invention, a chair 10 is shown having a back rest 70 and arms rest 82 and 84. The presence of back rest 70 and arm rests 82 and 84 are not required for the purpose of the adjustable chair of the present invention. In order for the present invention to function, the basic elements required are the seating area, the front and back support and the support member. The presence of back rest 70 and arm rests 82 and 84 are only to provide chair 10 with a more enjoyable seating. A worker skilled in the relevant art would be familiar as to how to make the chair 10 of the present invention function without the need for a back rest and arm rest.

Figure 4A:
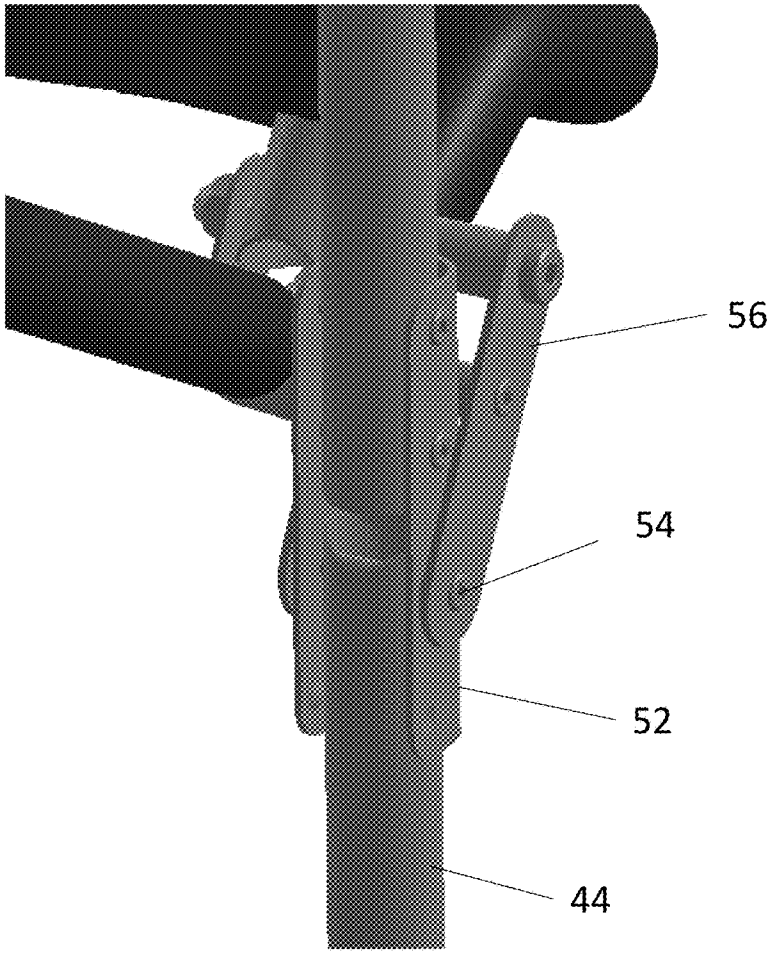
FIG. 4*a* is a magnified view of a fulcrum member as found in a portable adaptable chair according to one embodiment of the present invention.
Figure 4B:
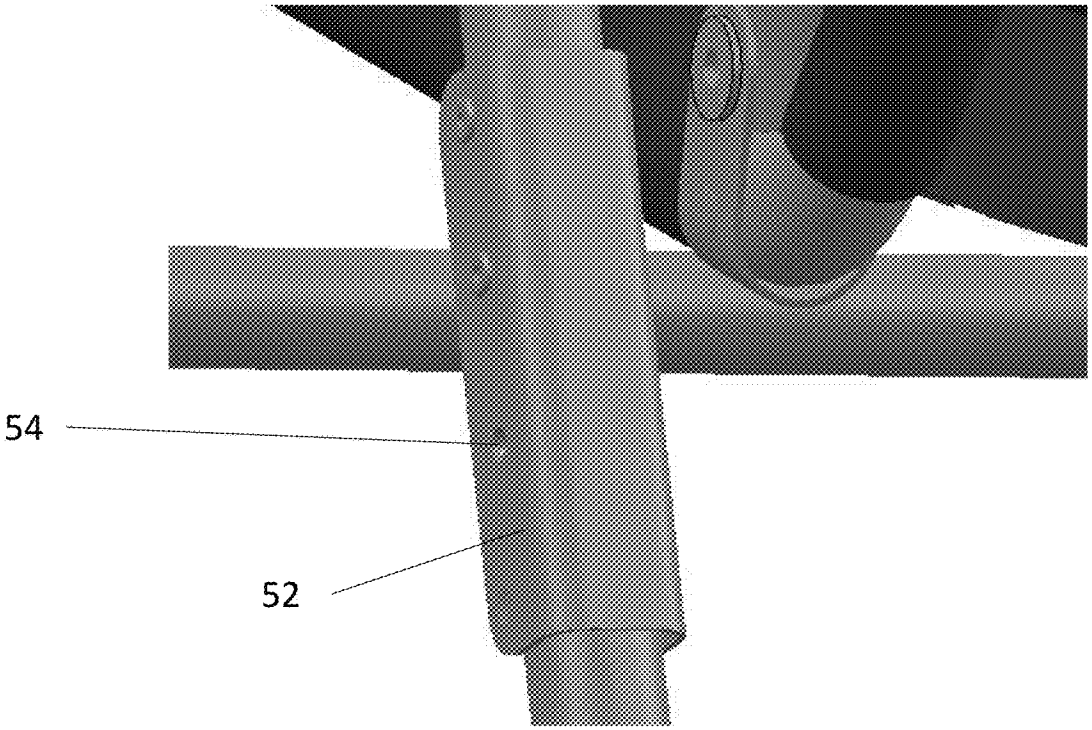
FIG. 4*b* is rear magnified view of a fulcrum member as found in a portable adaptable chair according to one embodiment of the present invention.

With reference to FIGS. 4*a* and 4*b* and according to one embodiment of the present invention, a magnified view of fulcrum 50 is shown which allows movement of back support (not shown). Fulcrum 50 is comprised of a u-shaped member 52 providing a pivot for leg 44 of back support. As will be shown in other figures and described below, pivot point 54 allows for leg 44 to be pivoted in a forward motion only. By moving leg 44 in a forward motion which in turn moves back support forward, any support by back support is removed and the back portion of the seating area must then be supported by support member (not shown). The u-shaped member 52 is only one embodiment and a worker skilled in the relevant art would be familiar with other applications which allow the movement of back support in a forward manner removing all support by the back support and not supporting the back portion of the seating area (not shown). For example, fulcrum 50 could consist of an attachment which allows the back support to be removed completely from the chair. Other applications could have back support moving in a backward motion as well or even allowing for movement of back support in both a forward or backward motion such as forward (towards) the seating area or backward (away) from the seating area of chair 10. In other embodiments, the fulcrum could consist of brackets or even flexible materials allowing movement of the back support.

With further reference to FIGS. 4*a* and 4*b* and according to one embodiment of the present invention, a reinforcement member 56 is shown in FIG. 4*a* but removed from FIG. 4*b* in order to better illustrate u-shaped member 52. Reinforcement member 56 is present to connect u-shaped member 52 to a back rest in order to provide more support if a back rest is positioned on a chair of the present invention.

Figure 5:
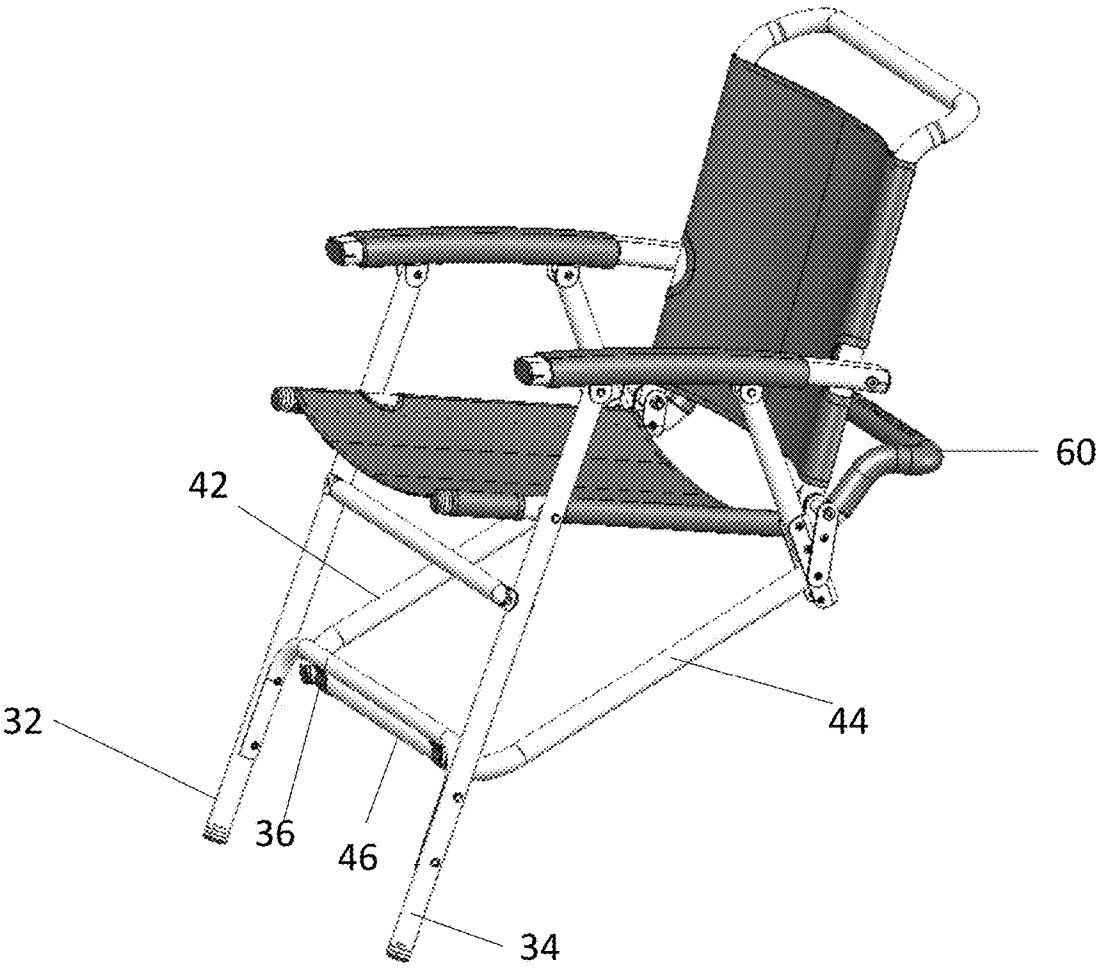
FIG. 5 is a perspective view of a portable adaptable chair having the back support moved to contact the front support according to one embodiment of the present invention.
Figure 6:
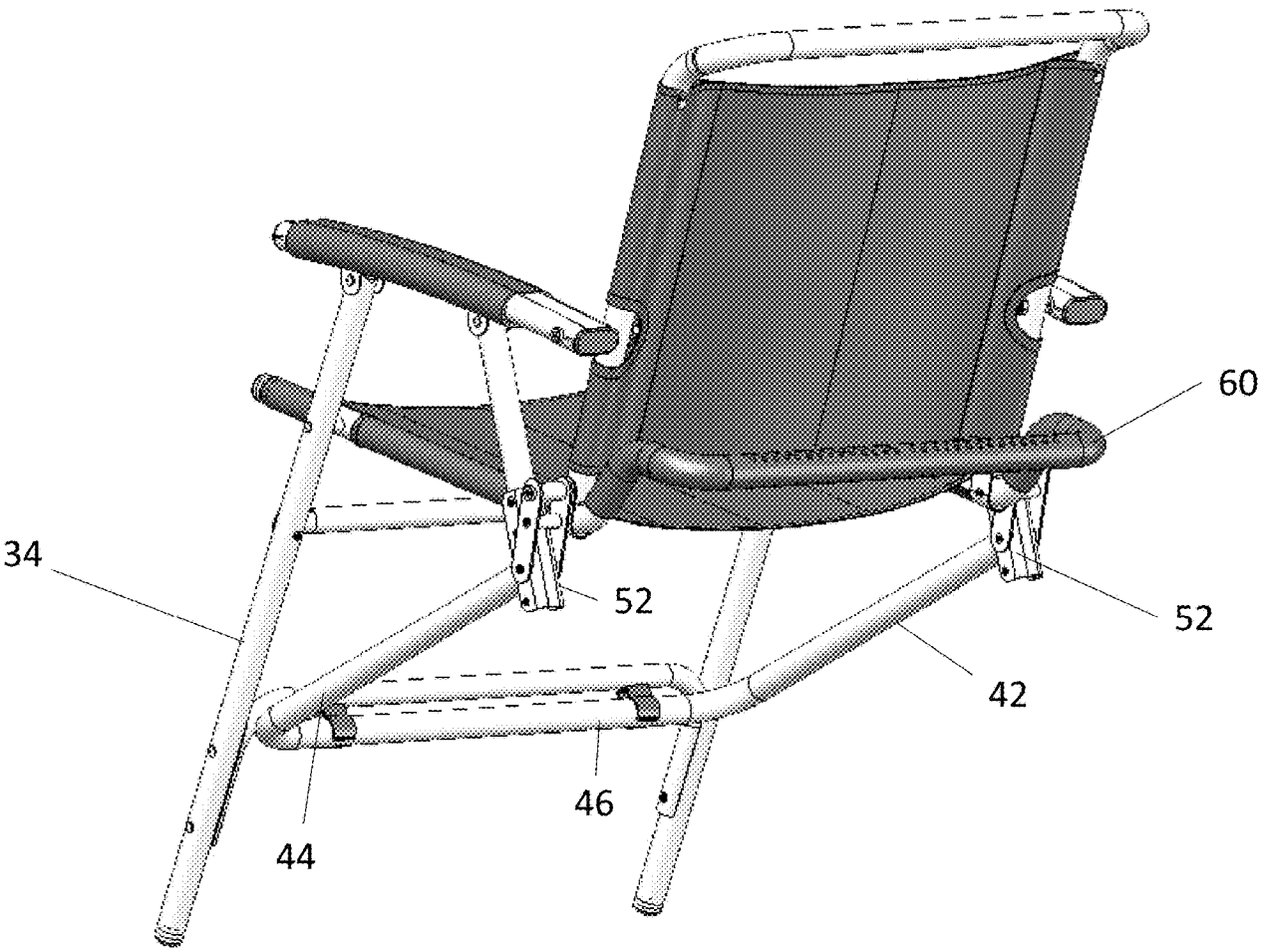
FIG. 6 is a rear perspective view of a portable adaptable chair having the back support moved to contact the front support according to one embodiment of the present invention.

With reference to FIGS. 5 and 6 and according to one embodiment of the present invention, chair 10 is shown with back support consisting of legs 42, 44 and cross member 46 moved in a manner that the back support is connected to front support consisting of legs 32, 34 and cross member 36. By moving the back support in such a manner, the back support can no longer support the back portion 24 of seating area 20. As will be shown in FIG. 8, support member 60 will then be able to provide the support now missing from the movement of back support as shown.

With further reference to FIG. 6 and according to one embodiment of the present invention, two fulcrum members 52 comprising of a u-shape member is positioned at the opposite ends of back portion 24 of seating area 20 allowing the movement of legs 44 and 42 away from back portion 24. The positioning of two fulcrum members 52 allows a pivot of legs 42 and 44.

Figure 7:
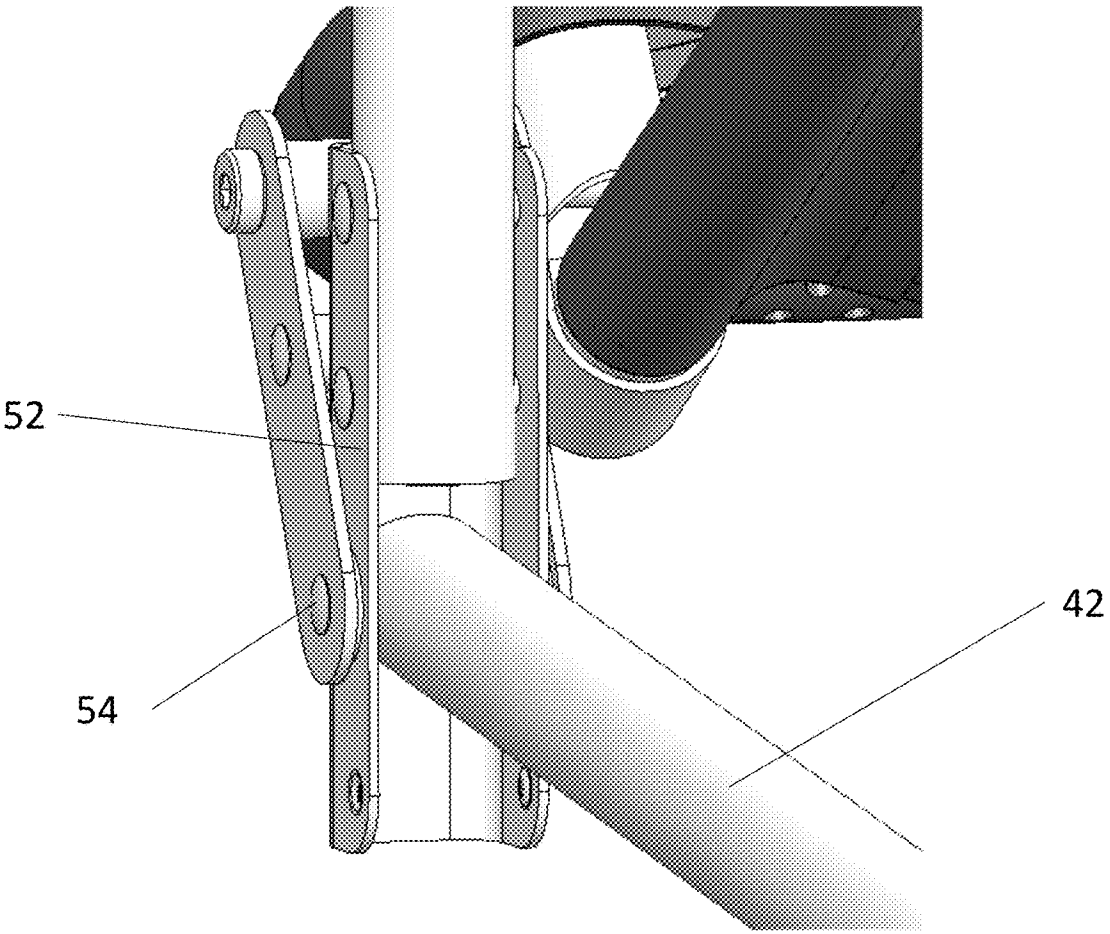
FIG. 7 is a magnified view of a fulcrum member as found in a portable adaptable chair allowing the back support to be moved and connect with the front support.

With reference to FIG. 7 and according to one embodiment of the present invention, fulcrum 50 is shown with u-shaped member 52 allowing leg 42 to pivot on pivot point 54 allowing for the displacement of back support as shown in FIGS. 5 and 6.

Figure 8:
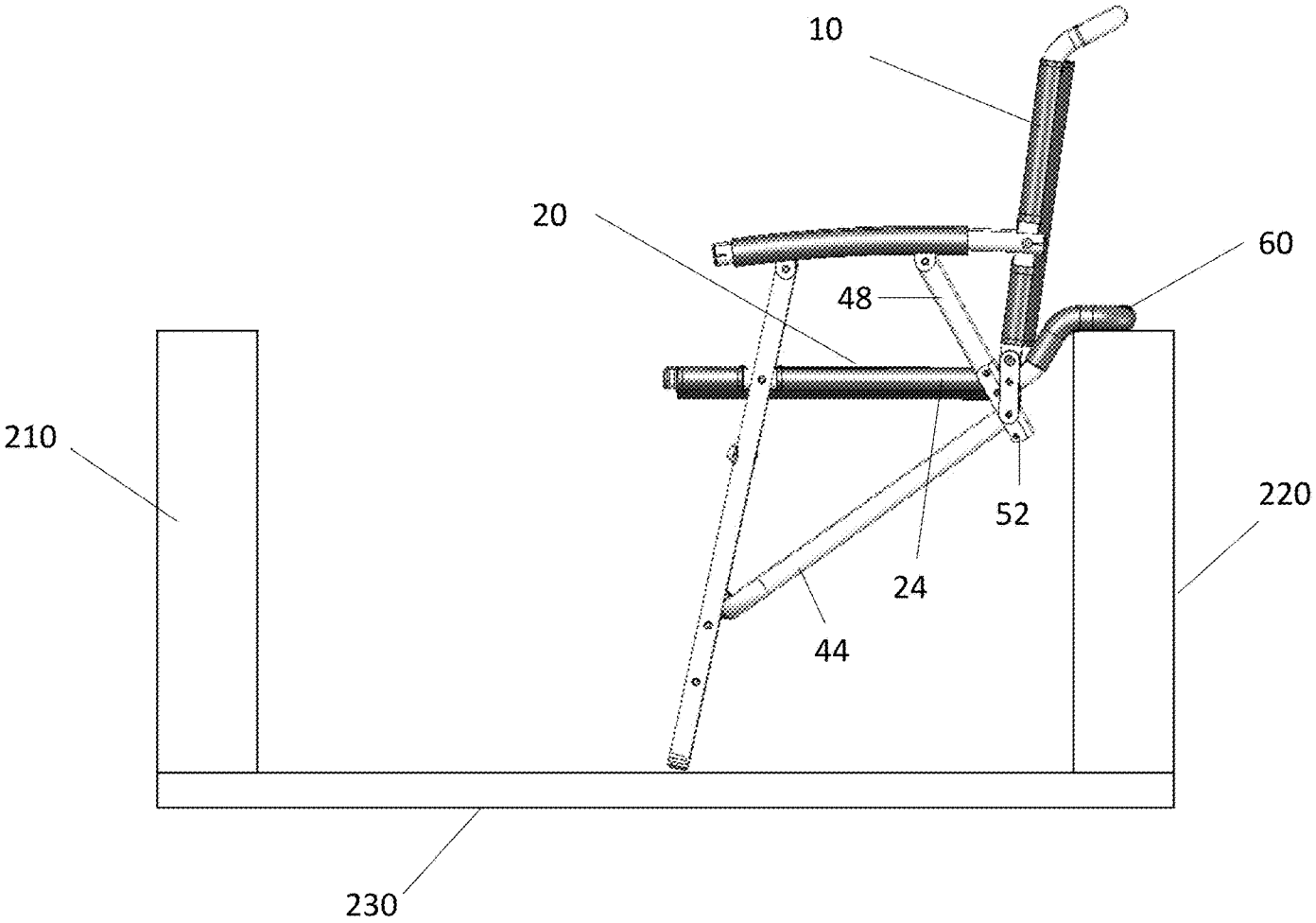
FIG. 8 is a side perspective view of a portable adaptable chair according to one embodiment of the present invention positioned within a truck bed.

With reference to FIG. 8 and according to one embodiment of the present invention, the chair 10 is positioned within a truck bed. A worker skilled in the relevant art would be familiar with the shape of a truck bed which is typically composed of two opposing walls 210 and 220 and a floor 230. As shown, chair 10 has support member 60 positioned on wall 220 of the truck bed allowing support for back portion 24 of seating area 20. The movement of back support consisting of legs 42, 44 and cross member 46 (with only leg 44 shown) allows the chair to be used by an individual within the truck bed while reducing the overall footprint a chair would occupy if back support was not connected to the front support. The entire support of back portion 24 of seating area 20 is transferred to support member 60.

With further reference to FIG. 8 and according to one embodiment of the present invention, the fulcrum consisting a u-shaped member 52 allowing to pivot legs 44 and 42 (only 44 shown has one end connected to leg 44 and another end connected to arm rest support 48. The movement of the back support is created through u-shaped member 52 having each end connected to separate members such as arm rest support 48 and leg 44. If arm rest support 48 is not present in one embodiment then fulcrum member needs to have one end connected to seating area 20. The presence of arm rest support 48 is not an essential element but rather the ability to have the back support pivot away from back portion 24 through the presence of fulcrum 52 is essential.

Figure 9:
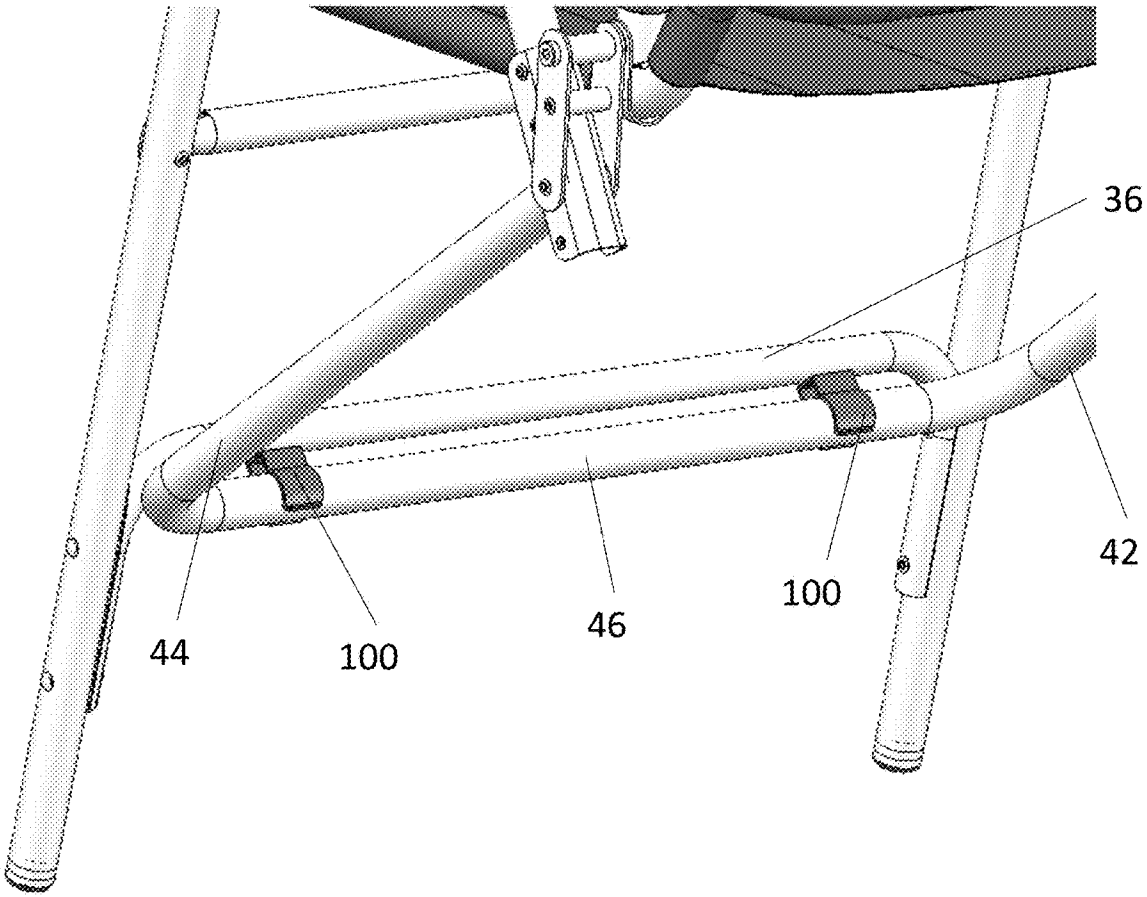
FIG. 9 is a magnified view of the back support being connected to the cross-member of the front support through the use of clips according to one embodiment of the present invention.

With reference to FIG. 9 and according to one embodiment of the present invention, the back support consisting of legs 42, 44 and cross member 46 is affixed to cross member 36 of front support through the use of clips 100. A worker skilled in the relevant art would be familiar with numerous applications which would allow for the back support to affixed to the front support without using clips as shown.

The present invention provides a portable adjustable chair which can be used in two configurations. A first configuration consisting of a standard configuration as is typically used by individuals and as shown in FIG. 1. The second configuration consist of reducing the overall footprint occupies by moving or removing the back support of the chair.

The displacement of the back support reduces the overall footprint occupied by the chair when both the front and back support are used to support the chair. The second configuration is best demonstrated as shown in FIG. 8.

A person understanding this invention may now conceive of alternative structures and embodiments or variations of the above all of which are intended to fall within the scope of the invention as defined in the claims that follow.

What is claimed is:

1. A portable adjustable chair comprising:

a seating area for receiving a person having a front portion and a back portion;

a front support connected to the front portion of the seating area for supporting the front portion of the seating area;

a back support connected to the back portion of the seating area for supporting the back portion of the seating area;

a support member connected to the seating area to support the back portion of the seating area; and, a fulcrum member allowing movement of the back support between a first seating position where the portable adjustable chair is supported by the front portion and the back portion, and a second seating position where the portable adjustable chair is supported by the front portion and the support member.

2. The portable adjustable chair according to claim 1 further comprising two fulcrum members positioned at the back portion of the seating area.

3. The portable adjustable chair according to claim 2 wherein the fulcrum members are u-shape members.

4. The portable adjustable chair according to claim 2 wherein the front support consists of two legs.

5. The portable adjustable chair according to claim 2 wherein the back support consists of two legs.

6. The portable adjustable chair according to claim 2 further comprising arm rests, arm rest supports and a back rest.

* * * * *